US012139906B2

(12) United States Patent
Fokas

(10) Patent No.: US 12,139,906 B2
(45) Date of Patent: Nov. 12, 2024

(54) DUAL CHANNEL DRAINAGE SEAL FOR CHANNELING WATER SEEPAGE AND MITIGATING RADON GAS ADMITTANCE IN A BASEMENT OR SUBTERRANEAN AREA

(71) Applicant: Dual Seal Drain LLC, Morganville, NJ (US)

(72) Inventor: Jerome Fokas, Holmdel, NJ (US)

(73) Assignee: Dual Seal Drain LLC, Morganville, NJ (US)

( * ) Notice: Subject to any disclaimer, the term of this patent is extended or adjusted under 35 U.S.C. 154(b) by 220 days.

(21) Appl. No.: 17/725,019

(22) Filed: Apr. 20, 2022

(65) Prior Publication Data

US 2022/0333370 A1 Oct. 20, 2022

Related U.S. Application Data

(60) Provisional application No. 63/177,146, filed on Apr. 20, 2021.

(51) Int. Cl.
*E04B 1/70* (2006.01)
*E02D 31/00* (2006.01)
*E02D 31/02* (2006.01)

(52) U.S. Cl.
CPC ..... *E04B 1/7023* (2013.01); *E02D 31/008* (2013.01); *E02D 31/02* (2013.01)

(58) Field of Classification Search
CPC ..... E04B 1/7023; E02D 31/008; E02D 31/02
USPC ..... 52/169.5, 274, 302.1, 302.3
See application file for complete search history.

(56) References Cited

U.S. PATENT DOCUMENTS 2,083,781 A * 6/1937 Groves ..... E04B 1/00 52/363
2,703,002 A * 3/1955 Suskind ..... E04B 1/7023 52/302.3
3,344,569 A * 10/1967 Cotten ..... E04B 1/7023 52/287.1

(Continued)

FOREIGN PATENT DOCUMENTS

KR 100642983 B1 11/2006

OTHER PUBLICATIONS

Interior Drainage Waterproofing Systems, Advanced Foundation Repair LLC, Available online at <https://www.advancedfoundationmissouri.com/interior_drainage_system.php>, Accessed from Internet on Mar. 25, 2021, 4 Pages.

(Continued)

*Primary Examiner* — Paola Agudelo
*Assistant Examiner* — Adam G Barlow
(74) *Attorney, Agent, or Firm* — Amster, Rothstein & Ebenstein LLP

(57) ABSTRACT

A dual channel drainage seal for enclosing a joint between a slab and a foundation sidewall of a subterranean area. The drainage seal includes and lower channel and an upper channel stacked over the lower channel. The lower channel is affixed on top of the slab and against the sidewall to form and enclosed channel for retaining and routing radon and/or water seepage at the joint to a sump pit. The upper channel is open on top and configured to capture and route water seepage from the sidewall above to the sump for discharge, thereby protecting the interior portions of the slab from radon and water damage.

20 Claims, 12 Drawing Sheets

(56) References Cited

U.S. PATENT DOCUMENTS 3,850,193 A * 11/1974 Guzzo ..... E03F 5/04 52/169.5
4,075,800 A * 2/1978 Molick ..... E04B 1/6803 52/302.3
4,333,281 A * 6/1982 Scarfone ..... E04B 1/7023 52/302.3
4,798,034 A * 1/1989 Jarnagin ..... E02D 31/008 52/741.1
4,837,991 A * 6/1989 Shaw ..... E02D 31/02 52/274
4,869,032 A * 9/1989 Geske ..... E04B 1/7023 52/287.1
5,199,232 A * 4/1993 Chandler ..... E04B 1/7023 52/169.5
5,367,842 A * 11/1994 Janesky ..... E04B 1/7023 52/169.5
5,501,044 A * 3/1996 Janesky ..... E04B 1/7023 52/287.1
5,630,299 A * 5/1997 Jackman ..... E04B 1/7023 52/302.1
5,694,723 A * 12/1997 Parker ..... E02D 27/32 404/4
5,771,643 A * 6/1998 Parker ..... E02D 27/32 52/302.1
5,784,838 A * 7/1998 Phillips ..... E04F 17/00 52/302.1
5,794,388 A * 8/1998 Jackman ..... E04B 1/7023 52/302.1
6,308,470 B1 * 10/2001 Durkovic ..... E04B 1/70 405/36
6,550,190 B2 * 4/2003 Ruiz ..... E04B 1/7023 52/302.1
6,598,360 B1 * 7/2003 Pratt ..... E02D 31/02 52/169.5
6,619,001 B1 * 9/2003 Pratt ..... E02D 31/02 52/302.1
7,832,156 B2 * 11/2010 Trotter ..... E04B 1/7069 52/302.3
8,186,127 B1 * 5/2012 Pratt ..... E02D 31/02 52/302.1
8,312,682 B2 * 11/2012 Trotter ..... E04B 1/7023 52/302.6
8,544,219 B1 10/2013 Janesky
9,353,498 B2 5/2016 Goldberg et al.
10,443,204 B2 * 10/2019 Clapper ..... E04G 11/06
10,448,580 B1 * 10/2019 Borras ..... A01G 9/28
2005/0204653 A1 * 9/2005 Matthews ..... E02D 31/02 52/169.4
2006/0150551 A1 * 7/2006 Bounds ..... E04B 1/7023 52/302.1
2007/0044396 A1 3/2007 Janesky
2007/0193151 A1 * 8/2007 Anderson ..... E04B 1/0007 52/302.3
2008/0184660 A1 8/2008 Forner et al.
2008/0190045 A1 * 8/2008 Janesky ..... E02D 31/02 52/169.5
2009/0183445 A1 * 7/2009 McPherson ..... E02D 31/02 52/302.3
2013/0036705 A1 * 2/2013 Trotter ..... E02D 31/02 52/742.14
2020/0270838 A1 8/2020 Nowak
2021/0087808 A1 * 3/2021 Hunter ..... E04B 1/7023
2023/0038717 A1 * 2/2023 Derry ..... E04B 1/70

OTHER PUBLICATIONS

Install The Right Drainage System For Your Home, Basement Waterproofing Solutions, Available online at <https://www.basementwps.com/basement-waterproofing/drain-systems/>, Accessed from Internet on Mar. 25, 2021, 4 Pages.

Form-A-Drain, Build Block, Available online at <https://buildblock.com/products/accessories/form-a-drain/>, Accessed from Internet on Mar. 25, 2021, 5 Pages.

* cited by examiner

DUAL CHANNEL DRAINAGE SEAL FOR CHANNELING WATER SEEPAGE AND MITIGATING RADON GAS ADMITTANCE IN A BASEMENT OR SUBTERRANEAN AREA

CROSS REFERENCE TO RELATED APPLICATIONS

This application claims priority to U.S. provisional application Ser. No. 63/177,146 filed on Apr. 20, 2021, the content of which is incorporated by reference in its entirety.

BACKGROUND OF INNOVATION

Field of Invention

The innovation is generally related to a vapor and water drainage system, and more specifically, to radon mitigation and water drainage in a basement or subterranean area.

Related Prior Art

Basements and other subterranean areas are often subject to water seepage through cracks in the foundation walls or the cement floor or slab. Water seepage that is not quickly and properly addressed can cause further damage to the property, such as attracting mold, which is often detrimental to the occupants. As well, basement/subterranean areas can also be subject to radon gas, which is a naturally-occurring radioactive gas that exits in various geographic areas, and prolonged exposure to radon gas is known to be hazardous to occupants. In view of these detrimental effects, builders, contractors and home owners spend significant time and expenses to implement various systems and devices to help mitigate the harmful effects of water seepage and/or radon gas in a basement/subterranean area.

Referring to FIG. 1, basements or other subterranean chamber/area 10 often include one or more trenches 15 to provide drainage channels in the cement floor or slab 14 proximate or adjacent to the vertical foundation walls 16. One technique is to partially form/excavate the trenches 15 in the slab 14 in which the ground thereunder is not exposed. The trenches are routed to a sump 25 (see, e.g., FIG. 7) in which a drainage pipe or a pump is provided to discharge the liquid out of the basement 10. Alternatively, well-known "French drains" can be installed in the basement, where the trenches 15 are fully formed/excavated through the slab 14 so that gravel and perforated conduits (not shown) are inserted in the trench 15 to direct and enable the flow of undesirable water seeping from the walls 16 into the sump for expulsion out of the basement 10. Preferably, the trenches and/or the slab 14 are pitched downwardly so that the liquid in the trenches is gravity-fed into the sump. Although the trenches and channels can help mitigate water damage in the basement, the trenches are subject to blockages from dirt and debris and, therefore, require frequent monitoring and maintenance. Moreover, the drainage trenches do not address or solve the problem of radon gas seeping through the trenches. Conversely, the open area formed by the trenches increase susceptibility to admittance of radon gas into the basement 10.

Referring to FIGS. 2 and 3, another prior art waterproofing drainage device 30 is shown. The drainage device 30 is configured for positioning in a basement 10, and more specifically on the foundation wall footer 12 along the joint 18 between the floor slab 14 and foundation wall 16. The drainage device 30 is formed from a solid, elongated, water impermeable material such as polyvinylchloride (PVC) or other ridged and durable water-impermeable material that is well-known in the art. The drainage device 30 can be cut to desired lengths to run along the footer 12 and sidewall 16 of the basement or subterranean area 10.

Referring to FIG. 3, the drainage device 30 includes a first vertical section 32 for placement against the foundation wall 16, a first horizontal section 34 extending outwardly in a direction away from, i.e., opposite of the wall 16, a downwardly angled or sloped section 36 extending from the first horizontal section 34, and a lip 38 or flange extending vertically from the lowermost portion of the sloped section 36. A second vertical section 40 is attached to an underside of the sloped section 36 rearward of the lip 38, i.e., closer to the wall 16, and a second horizontal section 42 extends a predetermined length inwardly towards the sidewall 16, e.g., a length vertically aligned where the transition between the first horizontal section 34 and sloped section 36 occurs. At or near the end of the second horizontal section 42 is formed a wall 44 or second lip extending upwardly from the top surface thereof to block dirt and debris which may overflow from the joint 18.

Two co-extruded resilient seals 46 extend along the bottom of the second horizontal section 42 to reduce flow of exterior wall water under the basement floor 14. Similarly, one or more rigid gussets 48, e.g., three gussets, extend rearwardly along the rear surface of the first vertical section 32 to provide small separation from the wall 16 or optional barrier layer 20. The gussets 48 block dirt and debris from rising from the joint 18, as well as channel overflow liquid between the gussets to the sump. Optionally, the barrier layer 20 is affixed to the sidewall 16 prior to installation of the drainage device 30 to provide a flat, smooth vertical surface area and help direct water seepage 8 and/or prevent radon gas from seeping through cracks and other openings that may exist in the foundation sidewall 16 of the basement 10. The underside of the horizontal section 34 and the second vertical section 40 of the drainage device 30 also forms a channel to enable the flow and drainage of water from the joint 18 along the sidewall 16 and beneath the slab 14, as best seen in FIG. 2. A disadvantage of this type of drainage device 30 is that it must be installed beneath the basement floor/slab and is not suitable for use in older construction subterranean areas without having to remove the floor slab. Moreover, the prior art drainage device 30 does not channel any seepage that may occur from the sidewall 16 of the basement area.

Other prior art drainage/ventilation devices include U.S. Pat. No. 5,694,723 to Parker, which discloses a concrete slab and wall spacer with water and radon removal elements. The device includes a cross-sectional, L-shaped elongate strip of semi-rigid, non-biodegradable material. At least halfway up the entire elongate vertical leg of the L-shape may be a horizontally disposed projection which is integral with the strip. The spacer projection is placed against a wall, the L base resting on a portion of the footing subtended by the wall in a conventional spacer usage. A spacer may be provided for additional support of the L-shaped strip. This spacer is easily removable after the floating slab has set, or the spacer may be left in place for use as a decorative molding. Several applications for the strip are disclosed, one being the sealing of the shelf to the abutting wall with placement of a gas impermeable membrane in an overlapping arrangement with the L base so as to form, relative to the strip and the abutted wall, an upper fluid region and a lower gas region. The gas region is vented by a conduit which penetrates the projection, while the water in the upper liquid region is removed by other conventional methods, conceivably by through-the-wall conduits or a sump region built into or adjacent the footing.

U.S. Pat. No. 7,832,156 to Trotter discloses a condensation inhibition system for structural waterproofing a dwelling having a wall and a foundation. The wall has a first surface for defining an interior of the dwelling and an exterior in communication with graded soil. The waterproofing system further includes a waterproofing panel having a front vapor diffusion retarder portion, a back vapor diffusion retarder portion, and an insulator carried between the front portion and the back portion. Additionally, a collection channel is provided for collecting water entering into the dwelling from the exterior.

U.S. Pat. No. 8,544,219B1 to Janesky discloses a system adapted to remove radon gas and drainage liquid from a subterranean chamber or basement having a floor and an ambient environment. The system has a drainage channel forming a drainage portion and a venting portion. A valve is located between the drainage portion and the venting portion. Drainage liquid flows into the drainage portion and from the drainage portion through the valve into the venting portion. A pressure gradient is between the drainage portion and the venting portion. The valve substantially prevents the ambient environment from entering the venting portion while allowing drainage liquid to flow from the drainage portion into the venting portion.

U.S. Pat. No. 9,353,498B2 to Goldberg discloses a building envelope assembly including a first structural wall frame, a flexible sheet, a drain assembly, and a seal. The flexible sheet is disposed along a surface of the first structural wall frame. The flexible sheet configured to transport moisture along two opposing surfaces. The flexible sheet includes an upper portion and a bottom portion having a moisture wicking sheet. The drain assembly is configured to receive moisture from the flexible sheet. The seal is attached to the bottom portion of the flexible sheet and is configured to prevent ingress of water, water vapor, and air toward the upper portion of the flexible sheet.

U.S. Pat. No. 10,443,204B2 to Clapper et al. discloses a system for a basement concrete form and drainage are disclosed. The system may include a lineal that is a horizontal concrete form or a footer for a wall and a basement floor. The lineal may include a rectilinear tubular structure having a cavity, an outer wall, and drain perforations in the outer wall to permit fluid transmission from the cavity to an exterior of the lineal. In addition, a retainer may be mounted to a stake for the basement concrete form when the stake is embedded in a formation underlying the lineal. The retainer may be selectively vertically positioned along the stake to adjust a height of the lineal relative to the underlying formation.

US publication no. US2006/0150551A1 to Bounds et al. discloses a water drainage device that includes multiple flow channels to allow water to bypass a clogged area of a flow channel. Preferably, one the flow channels is filtered to impede the build of particulate matter and sediment in the channel. The water drainage device includes a frame and a filter element. The frame has a first flow channel and a second flow channel. The first flow channel is positioned generally above the second flow channel. The first channel has an open end along its length.

US publication no. 2007/0044396A1 to Janesky discloses a drainage conduit system for an at least partially subterranean room having a floor over footings upon which a wall is provided. The system comprises a subfloor drain channel arranged to be disposed under the floor and over the footing when installed and a wall flashing adapted to be connected to the drain channel when installed, and having a back disposed for contacting the wall. When installed, the back of the wall flashing contacts the wall and the wall flashing is adjustably connected to the drain channel so that the wall flashing and the drain channel together define a drainage void with a selectably variable space extending away from the wall.

US publication no. 2008/0184660A1 to Forner et al. discloses a basement wall and floor system including a plurality of connected horizontally and vertically disposed panels. Each panel includes a metal C-channel defining an end thereof. Another metal C-channel defines an opposite end. A plurality of metal studs extends between the C-channels and fit between inside and outside flanges of the C-channels. A metal deck including an outwardly disposed facade and an inwardly disposed face is connected to the studs. Insulation is disposed on the facade side of the metal deck. A waterproofing material is disposed on the insulation.

US publication no. 2020/0270838A1 to Nowak discloses a vapor mitigation apparatus having a vertical securing piece configured to be affixed to a foundation wall proximate a footing that is supporting the foundation wall. The vertical securing piece has a first end located proximate to a footing and a second end. A horizontal foot is located at the first end of the securing piece and extends away from the securing piece. The horizontal foot is configured to rest against the footing. The apparatus also includes a mechanical clip located at the second end of the vertical securing piece and is configured to secure a piece of plastic sheeting.

The systems, devices and methods of the prior art are primarily used with new construction edifices and dwellings in which the drainage/ventilation systems are provided on the foundation footings below the cement slab. In older homes, installation of the prior art drainage/ventilation systems requires excavation of the slab near the foundation wall, such as shown in FIG. 3, which can be disruptive in terms of time and disorder, as well as costly to the property owner.

SUMMARY

The disadvantages of the prior art are overcome by a novel dual channel drain seal of the present invention. Advantageously, a novel dual channel drainage seal is provided for enclosing a joint between a slab and a foundation sidewall of a subterranean area. The drainage seal includes and lower channel and an upper channel stacked over the lower channel. The lower channel is affixed on top of the slab and against the sidewall to form and enclosed channel for retaining and routing radon and/or water seepage at the joint to a sump pit. The upper channel is open on top and configured to capture and route water seepage from the sidewall above to the sump for discharge, thereby protecting the interior portions of the slab from radon and water damage.

In one embodiment, a dual channel drainage seal for enclosing a joint between a slab and a foundation sidewall of a subterranean area comprises: a first vertical wall section having an outer surface configured for placement against the sidewall and an opposing inner surface; a second vertical wall section spaced-apart from the first vertical wall section and having an inner surface; a first horizontal wall section having a first end affixed to a lower portion of the inner surface of the first vertical wall section and a second end affixed to a mid-portion of the inner surface of the second vertical wall section; a second horizontal wall section affixed to a lower edge of the second vertical wall section, the second horizontal wall section being configured for placement against the slab; and wherein the second horizontal wall section, a lower portion of the second vertical wall section and a bottom surface of the first horizontal wall section collectively define a lower channel, and wherein an upper surface of the first horizontal wall section, a portion of the first vertical wall section which extends above the first horizontal wall section, and an inner surface of the second vertical wall section which extend above the first horizontal wall section collectively define an upper channel of the dual channel drainage seal.

In one aspect the lower channel is arranged over the joint to channel radon gas admitted through the joint away from the subterranean area. In another aspect, the lower channel is arranged over the joint to direct flow of liquids accumulating therein to a sump or discharge conduit. In still another aspect, the dual channel drainage seal is fabricated from polyvinylchloride material. In a further aspect, the outer surface of the first vertical wall section includes a plurality of protrusions. In yet another aspect, the bottom surface of the second horizontal wall section includes a plurality of protrusions. In still a further aspect, the first vertical wall section is perpendicular to the first horizontal wall section. In another aspect, the second vertical wall section is perpendicular to the second horizontal wall section. In yet another aspect, the second vertical wall section is perpendicular to the first horizontal wall section. In a further aspect, the first horizontal wall section is affixed to a lower edge of the first vertical wall section. In yet another aspect, the upper channel is positioned over the lower channel.

In another embodiment, an elongated dual channel drainage seal is provided for enclosing a joint between a slab and a foundation sidewall of a subterranean area. The dual channel drainage seal comprises: an upper drainage channel stacked over a lower drainage channel, the lower drainage channel having at least one sidewall configured to abut against the slab and form an enclosure between the slab and the foundation sidewall; and the upper channel having at least one sidewall configured to abut against the foundation sidewall, wherein the at least one sidewall forms a U-shaped channel having a top opening configured to collect water seepage through the foundation sidewall at height above the U-shaped channel.

Figure 1:
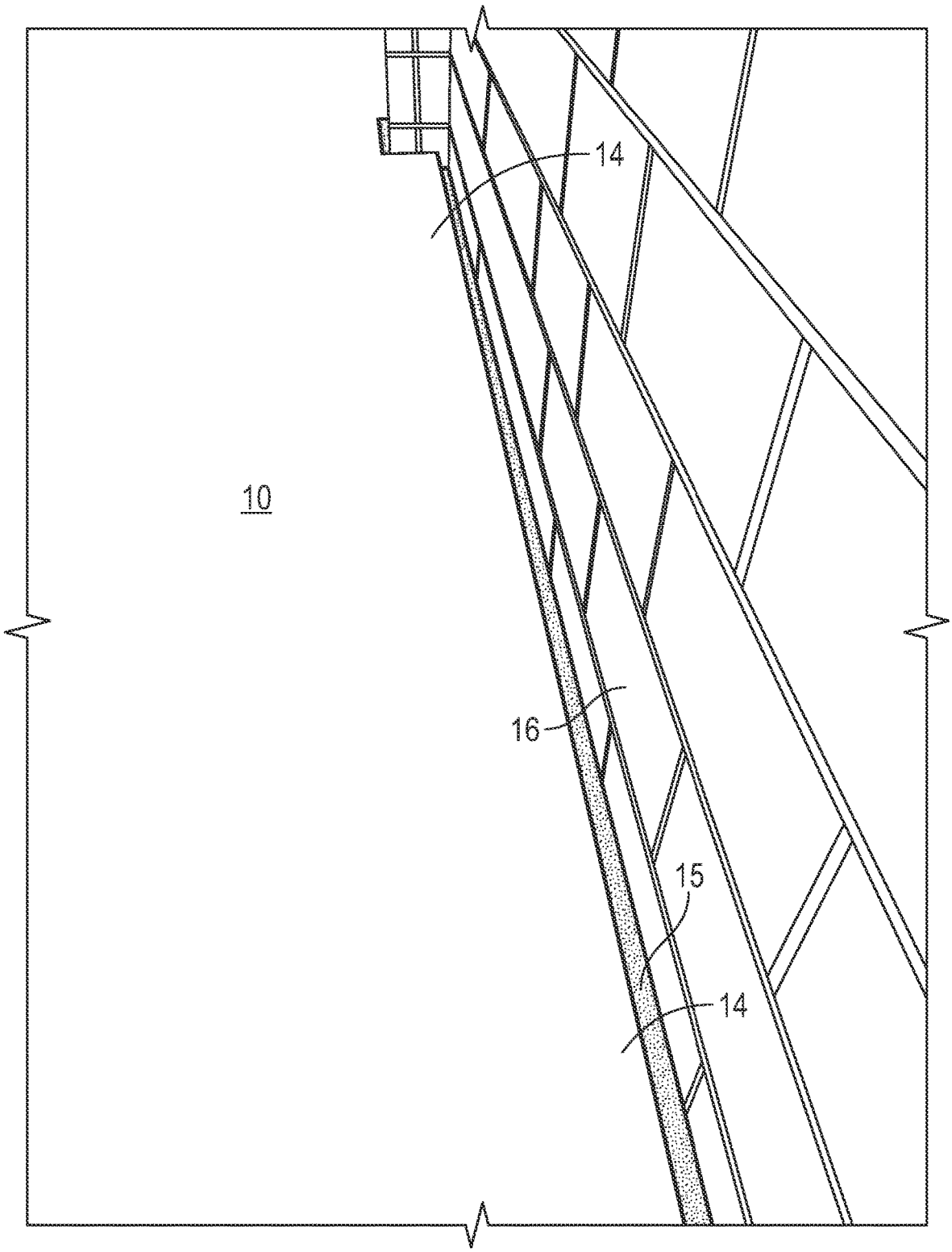
FIG. 1 (Prior Art)
FIG. 1 is a top perspective view of a basement area having a prior art drainage channel formed between the concrete slab and foundation wall.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

The present invention is a dual channel drainage seal for channeling water seepage and mitigating radon gas entry in a basement or subterranean area. The dual channel drainage seal is installed over a joint or trench formed at the joint at which the basement slab and the foundation sidewalls meet. A first lower channel effectively blocks the admittance of radon gas from the joint or trench and directs any radon gas entering the first lower channel outside of the basement or subterranean area. Additionally, the first lower channel diverts water seepage therein from the joint or trench to a sump or drainage conduit for discharge out of the basement or subterranean area. An upper channel of the drainage seal enables any water seepage from the foundation sidewall there-above to be routed into the sump or drainage conduit for discharge out of the basement or subterranean area, thereby protecting the slab and interior area of the basement or subterranean area undesirable water seepage and moisture.

Figure 2:
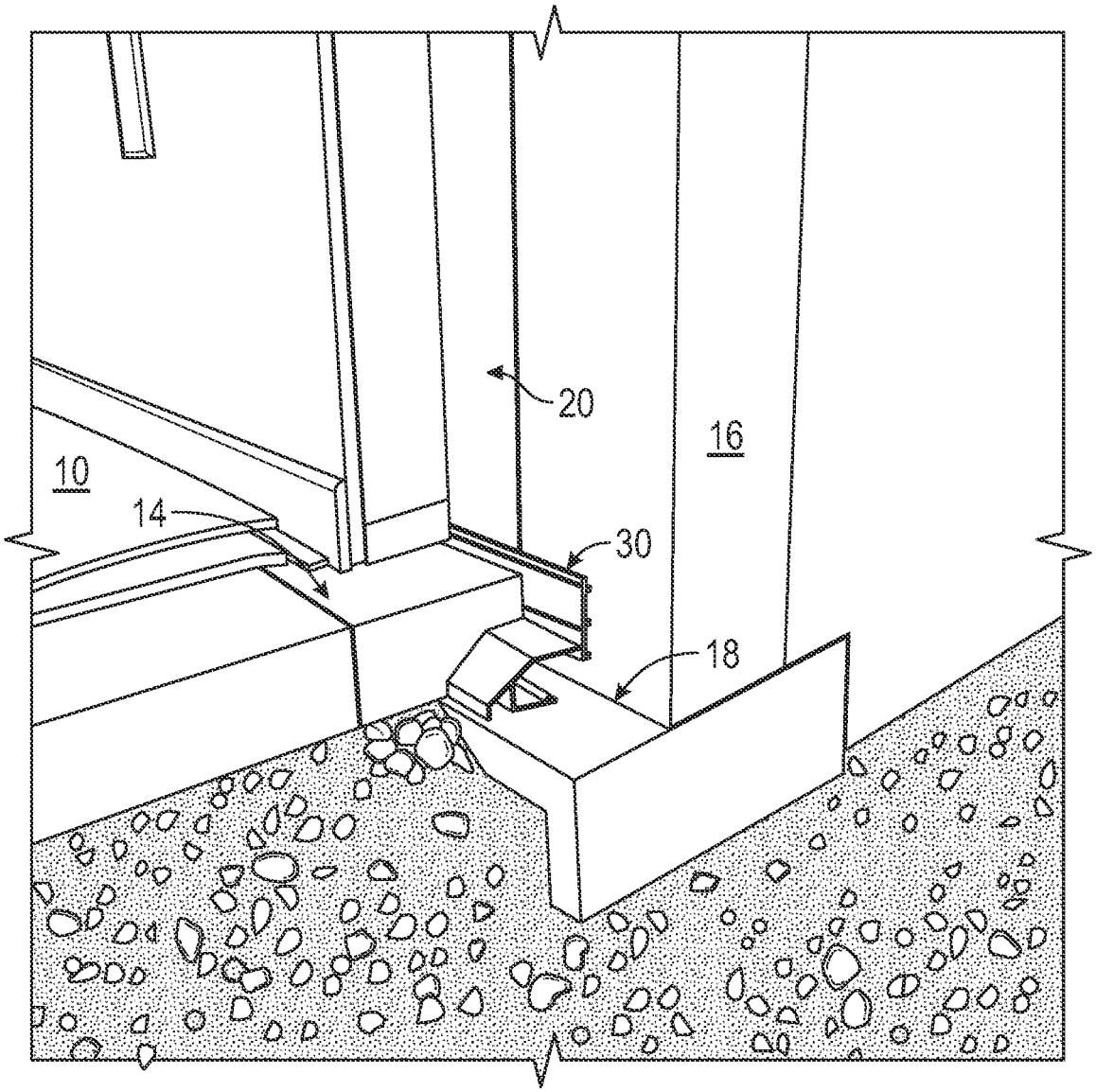
FIG. 2 (Prior Art)
FIG. 2 is a top right side perspective view of a basement room having a prior art waterproofing drainage device installed on a foundation wall footing and below the concrete slab.
Figure 3:
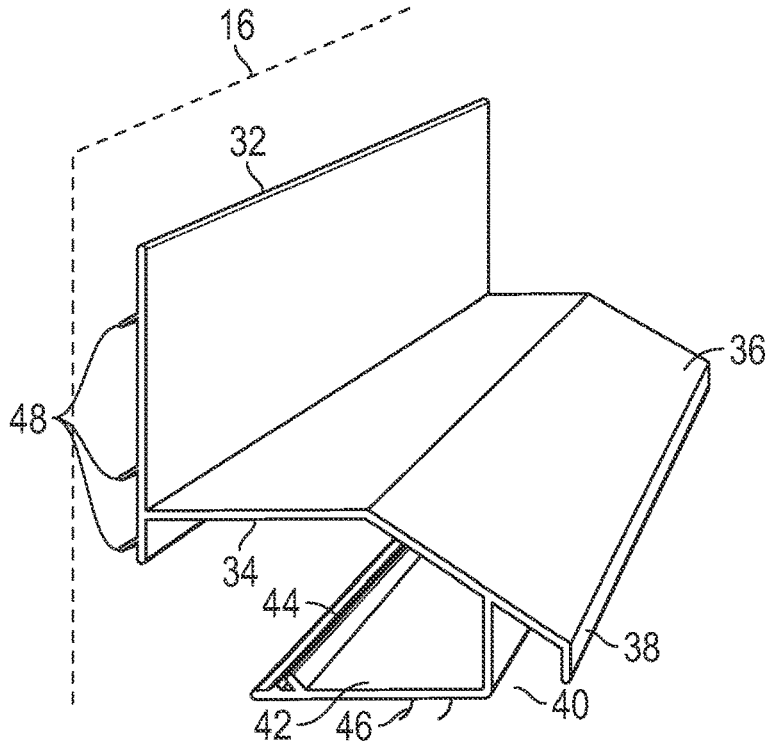
FIG. 3 (Prior Art)
FIG. 3 depicts an enlarged top, left side, perspective view of the prior art waterproofing drainage device of FIG. 2.
Figure 4:
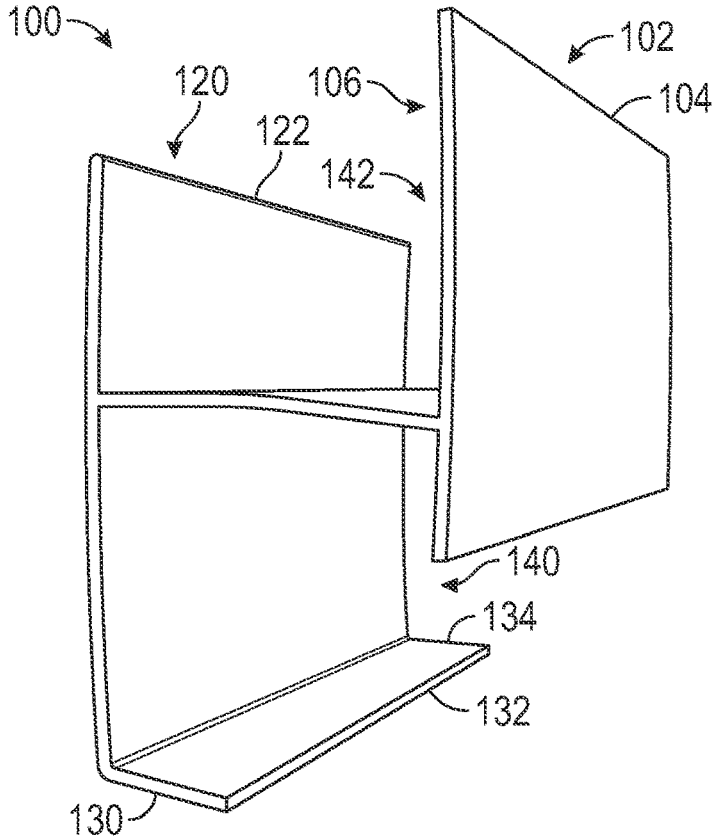
FIG. 4 is a top, left-side perspective view of a first embodiment of a dual channel drainage seal device of the present invention suitable for use on a slab and foundation wall of a basement or subterranean area.
Figure 5:
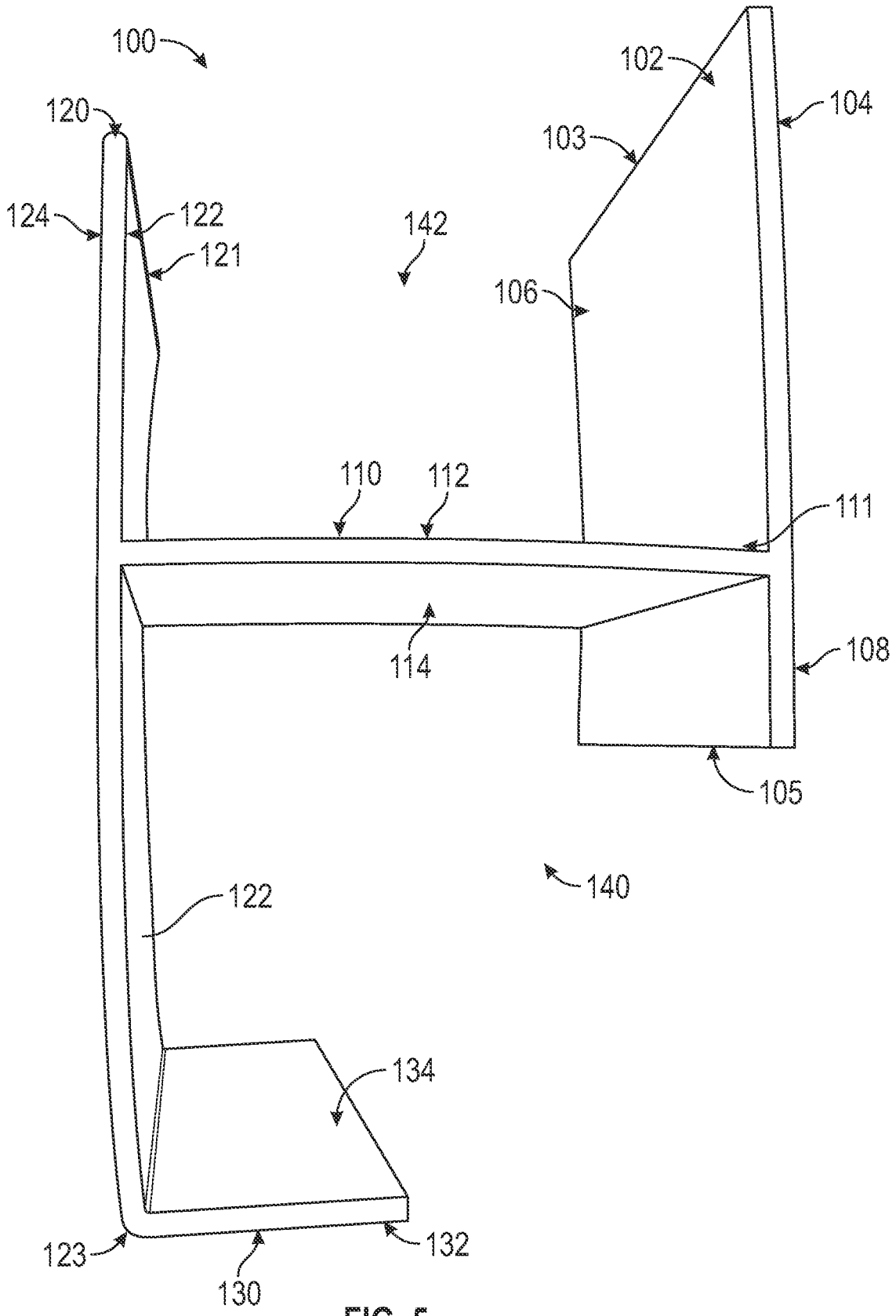
FIG. 5 is a side elevation view of the dual channel drainage seal device of FIG. 4.

FIGS. 4-5 depict a first embodiment of a novel dual channel drainage seal 100, which is configured for installation directly on a top surface of the slab 14 and against the foundation sidewall 16 to thereby cover a drainage trench 15 formed at the joint 18 between the slab 14 and wall 16 of a basement 10, such as illustratively shown in FIGS. 1-2. Thus, the dual channel drainage seal 100 differs from the prior art, since it is configured for installation above the slab 14 instead of beneath the slab 14 and addresses and solves undesirable admittance of both radon gas and water seepage 8. The dual channel drainage seal 100 includes a plurality of walls or sections including a first vertical wall section 102 having an outer rear surface 104 and an inner surface 106, a first horizontal wall section 110 having a top surface 112 and a bottom surface 114, a second vertical wall section 120 having an inner surface 122 and an outer surface 124, and a second horizontal wall section 130 having a bottom surface 132 and top surface 134. The outer rear surface 104 of the first vertical wall section 102 is configured for being bonded or otherwise securely fastened in a watertight manner against the vertical foundation wall 16, and the bottom surface 132 of the second horizontal wall section 130 is configured for being bonded or otherwise securely fastened in a watertight manner on the upper surface of the horizontal slab 14.

The first horizontal wall section 110 is provided between the first and second vertical wall sections 102, 120 such that the first and second vertical wall sections 102 and 120 are parallel or substantially parallel to each other. The first horizontal wall section 110 has a first end 111 that is attached to the inner surface 106 of, and midway or at a lower portion between, the upper and lower edges 103, 105 of the first vertical wall section 102. An opposing second end 113 of the first horizontal wall section 110 is attached to the inner surface 122 of, and substantially midway between, the upper and lower edges 121, 123 of the second vertical wall section 120. The positioning of the first horizontal wall section 110 is such that the bottom edge 105 of the first vertical wall section 110 is at a height above the bottom edge 123 of the second vertical wall section 120. The second horizontal wall section 130 is attached at the bottom edge 123 of the second vertical wall section 120 and extends inwardly in a direction towards the first vertical wall section 102. The first and second horizontal wall sections 102, 130 are preferably parallel or substantially parallel to each other. The second horizontal wall section 130 extends inwardly a distance suitable for affixing the drainage seal 100 to the top surface of the slab 10. For example, the second horizontal wall section 130 extends inwardly a distance of approximately midway of the first horizontal wall section 110, although such length is not considered limiting The bottom surface 114 of the first horizontal wall section 110, a lower portion of the inner surface 122 of the second vertical wall section 120 which extends below the first horizontal wall section 110, and the top surface 134 of the second horizontal wall section 130 collectively form a lower channel 140 of the dual channel drainage seal 100. The lower channel 140 is fully closed when the dual channel drainage seal 100 is installed and secured on the slab 14 and sidewall 16, both of which form a part of the closed lower channel 140 Additionally, the inner surface 106 of the first vertical channel 102, the top surface 112 of the first horizontal wall section 110, and an upper portion of the inner surface 122 of the second vertical wall section 120 which extends above the first horizontal wall section 110 collectively form an upper channel 142 of the dual channel drainage seal 100.

Figure 6:
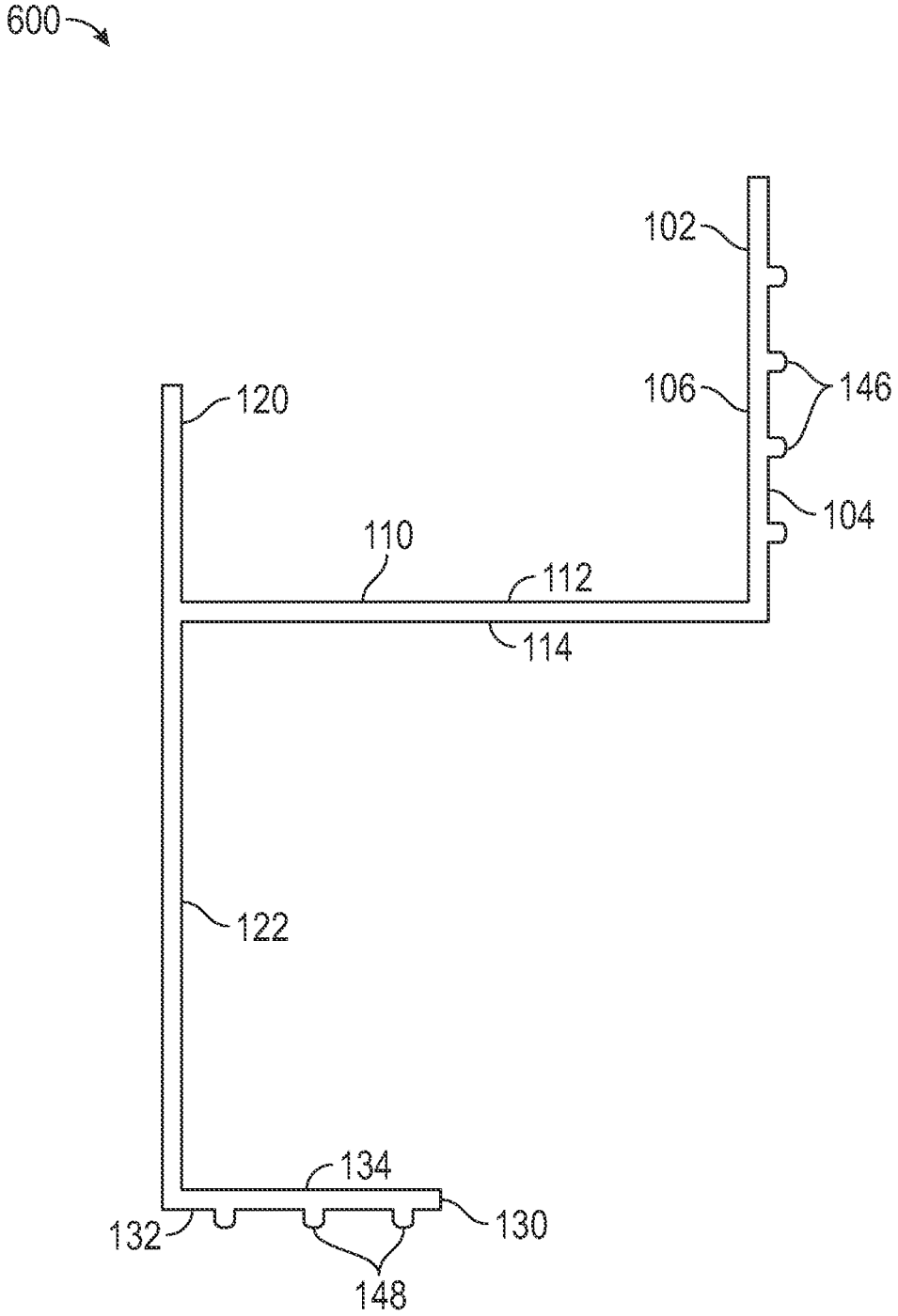
FIG. 6 is a side elevation view of a second embodiment of the dual channel drainage seal device of FIG. 5 including illustrative dimensions of the device.

In the novel embodiments shown in FIGS. 4-6, the various sections are illustratively configured perpendicular to one another. That is, the first and second horizontal wall sections 110, 130 are perpendicular to the first and second vertical wall sections 102, 120. The first vertical wall section 102 and second horizontal wall section 130 are configured vertically and horizontally, respectively, so as to best conform with the vertical and horizontal orientations of the side wall 16 and slab 14, respectively. It is understood by a person of ordinary skill in the art for which the invention pertains that the first horizontal wall section 110 and the second vertical wall section 120 can be curvilinear in shape and connected substantially perpendicular to the first vertical wall section 102 and the second horizontal wall section 130, as long as the stacked upper and lower (dual) channels 140 and 142 are maintained to block radon gas from seeping into the basement area 10 and directing water flow away from the slab to a sump or discharge conduit. More specifically, the upper channel 142 is suitable for collecting and diverting seepage 8 (see FIGS. 8-9) that flows through the side wall 16, while the lower channel 140 is suitable for collecting and diverting leaks and seepage that often originate around windows and/or pipe leaks.

Figure 11:
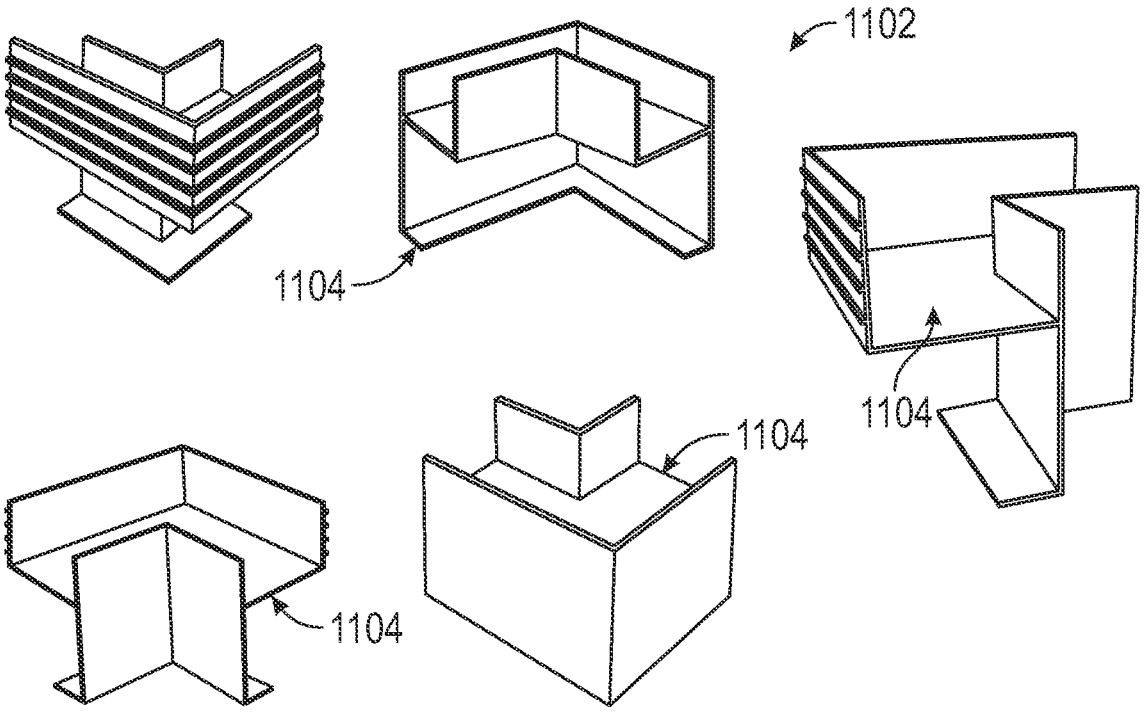
FIG. 11 depict various views of a corner section of the dual channel drainage seal device of FIG. 4.

The dual channel drainage seal 100 is preferably fabricated from a solid, elongated, water impermeable material such as polyvinylchloride (PVC) or other ridged and durable water impermeable material well-known in the art. The dual channel drainage seal 100 is preferably fabricated by extruded plastic molding or the wall sections can be welded together, among other well-known fabrication techniques and processes. Similarly, dual channel corner sections 1102, as illustratively shown in FIG. 11, are preferably fabricated by injection molding, among other well-known techniques.

Figure 10:
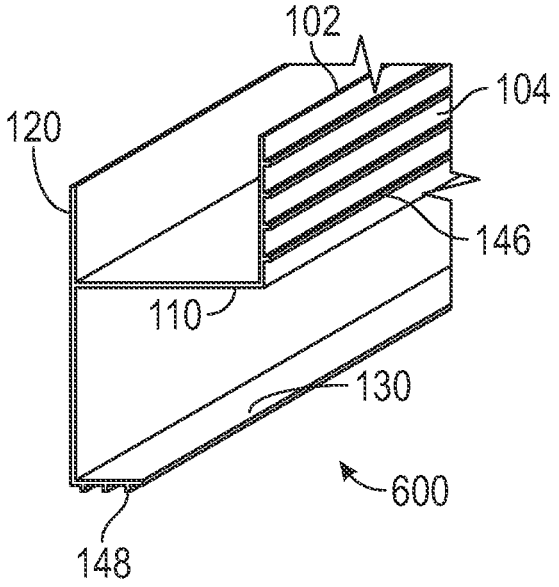
FIG. 10 is a top rear perspective view of the dual channel drainage seal device of FIG. 4

Referring to FIGS. 6 and 10, a second embodiment of the dual channel drainage seal 600 is shown. Specifically, FIG. 6 depicts a side elevation view and FIG. 10 depicts a top, rear elevation view of the dual channel drainage seal 600. The first and second embodiments are identical except that the lower portion 108 of the first vertical section 102 does not extend below the first horizontal section 110. Rather, the first end 111 of the first horizontal wall section 110 is attached to the bottom edge 105 of the first vertical wall section 102. Additionally, the outer rear surface 104 of the first vertical wall section 102 includes a plurality of rigid or semi-rigid fins or protrusions 146 which extend longitudinally along the lengths of the outer surface 104. Similarly, the bottom surface 132 of the second horizontal wall section 130 includes a plurality of rigid or semi-rigid fins or protrusions 148 that extend longitudinally along the length of the bottom surface 132. The protrusions 146 and 148 serve as spacers to receive a waterproof adhesive or sealant material to secure and provide a watertight seal as between the first vertical wall section 102 and the adjacent sidewall 106, and the second horizontal wall section 130 and the slab 14 of the basement. The protrusions 146 and 148 are illustratively shown as rectangular in shape, which extend outwardly perpendicular from the outer surface 104 of the first vertical wall section 102 and the bottom surface 132 of the second horizontal wall section. However, a person of ordinary skill in the art will appreciate that such shape is not considered limiting.

FIG. 6 also shows preferred dimensions of the vertical and horizontal wall sections 102, 110, 120 and 130. In one embodiment, each of the sections 102, 110, 120 and 130 have a thickness of are approximately 1/16 (0.06) inches, the lower channel 140 has a height and width of approximately 2.0×2.0 inches, and the upper channel 142 has a height and width of approximately 1.5×2.0 inches. A person of ordinary skill in the art will appreciate that the dimensions are not considered limiting and the various wall sections 102, 110, 120 and 130 can be sized to accommodate the dimensions (e.g., width) of the trench 15 formed in the basement 10. The overall lengths of the dual channel drainage seal 600 is in a range of 6 to 10 feet, although such lengths are not considered limiting.

Although the lower and upper channels 140, 142 are preferably depicted as being rectangular in shape as formed by the vertical and horizontal walls 102, 110, 120, 130 positioned at or substantially at right angles to each other, such shape is not considered limiting, as the drain seal 100 can be curvilinear in shape. For example, the first horizontal wall section 110 can be curved, e.g., concave in shape from a top view perspective of the drain seal 100 to collect any seepage through the wall 16 thereabove, and/or the second vertical wall 120 can have a rounded and/or curvilinear shape. Moreover, the first vertical wall section 102 and second horizontal wall section 130 can be customized to conform to a specific shape of a slab 10 and/or foundation wall 16, as required.

Referring now to FIG. 11, various perspective views of a corner section 1102 of the dual channel drainage seal 600 is illustratively shown. Although the corner section 1102 conforms to the second embodiment of the dual channel drainage seal 600, a person of ordinary skill in the art will appreciate that the corner section can conform to the first embodiment of the dual channel drainage seal 100, as shown in FIGS. 4-5. In either embodiment, the corner section 1102 forms the upper and lower channels which include stacked right-angles 1104, which transport the fluids and/or block any gases at the corner locations of the edifice, as illustratively shown in FIG. 7.

Figure 7:
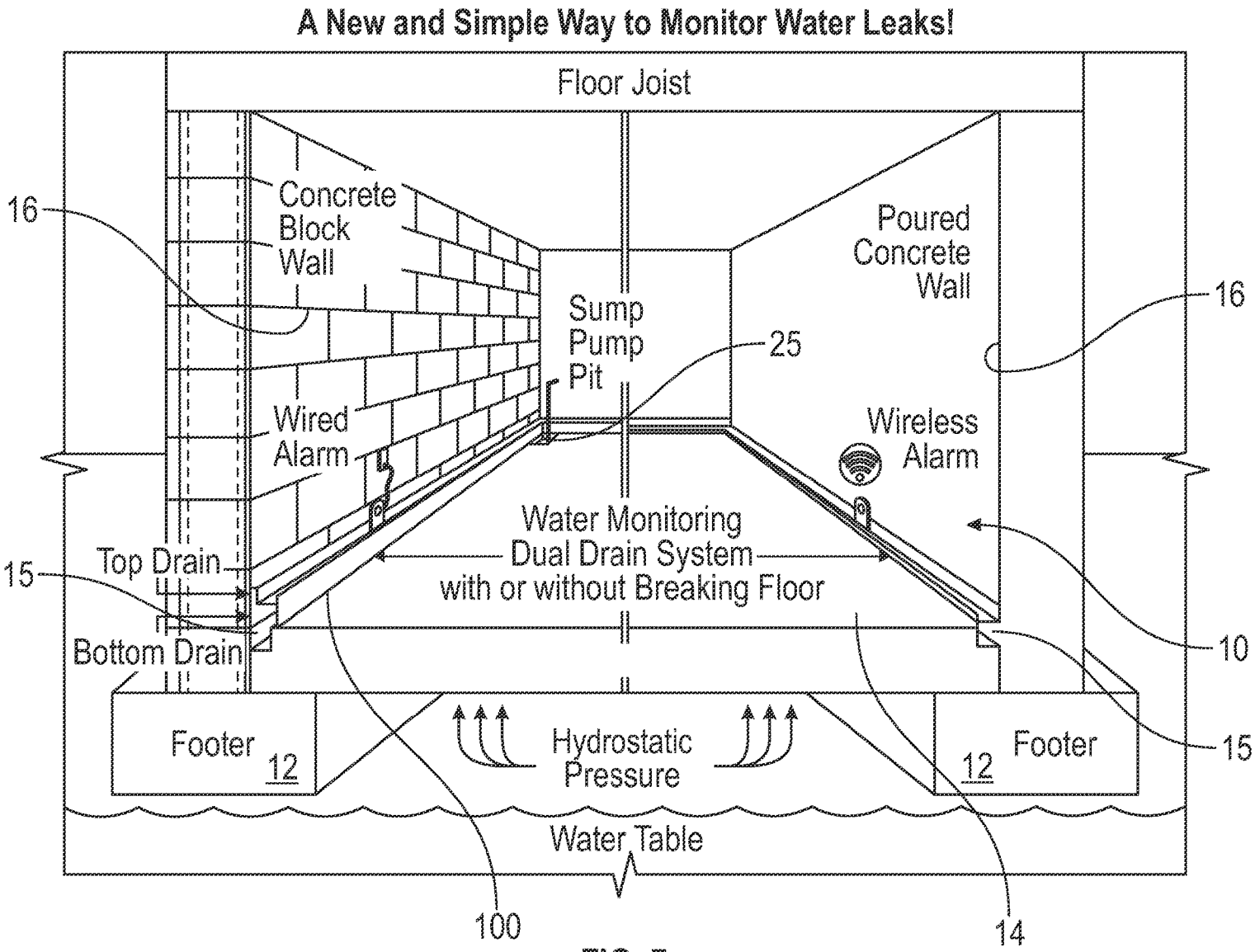
FIG. 7 is a front perspective view of a subterranean structure illustrating the dual channel drainage seal device of FIG. 4 positioned against a left-side concrete block wall and over a partial trench formed in the slab, and positioned against a right-side poured concrete wall within the partial trench formed in the slab.
Figure 8:
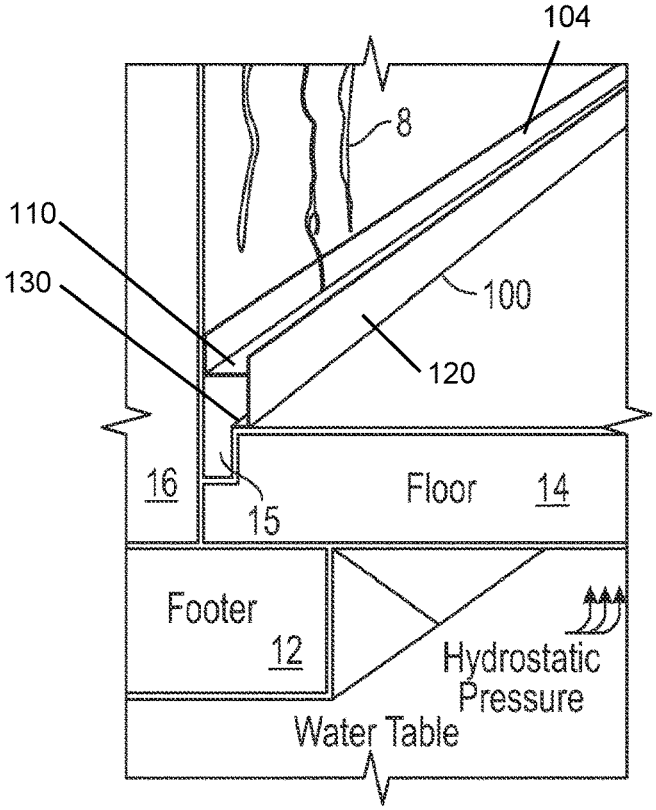
FIG. 8 is an enlarged view of FIG. 7 showing the dual channel drainage seal device of FIG. 4 positioned against the left-side concrete block wall and over the partial trench formed in the slab.
Figure 9:
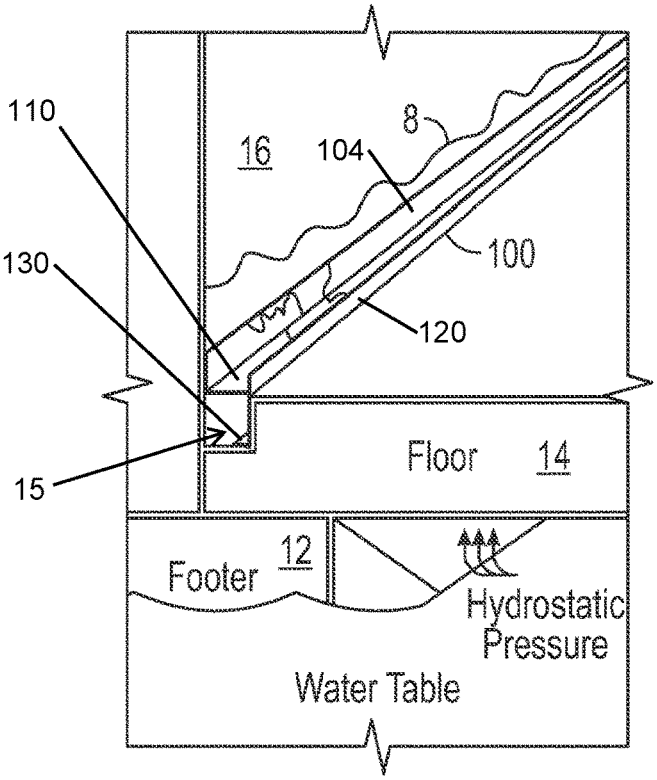
FIG. 9 is an enlarged view of FIG. 7 showing the dual channel drainage seal device of FIG. 4 positioned against a right-side poured concrete wall within the partial trench formed in the slab.

Referring now to FIGS. 7-9, FIG. 7 is a front perspective view of a subterranean structure illustrating the installation of the dual channel drainage seal device 100, 600 positioned against a left-side concrete block wall 16 and over a partial trench 15 formed in the slab 14, and positioned against a right-side poured concrete wall 16 within the partial trench 15 formed in the slab 14. FIG. 8 is an enlarged view of FIG. 7 showing the dual channel drainage seal device 100, 600 positioned against the left-side concrete block wall 16 and having the second horizontal wall 130 positioned on top of the slab 14, such that the lower channel 140 is arranged over the partial trench 15 formed in the slab 14. FIG. 9 is an alternative enlarged view of FIG. 7 showing the dual channel drainage seal device 100, 600 positioned against the left-side poured concrete wall 16 and having the second horizontal wall 130 positioned within the partial trench 15 formed in the slab 14, such that at least a portion of the lower channel 140 is arranged within the partial trench 15.

During installation, the slab 14 and lower sidewall 16 areas around the trench 15 are cleaned to eliminate any loose debris, particles and dust. One or more beads of a water-impermeable sealant, e.g., silicon, is run along the lengths of the outer surface 104 of the first vertical wall section 102 and the bottom surface 132 of the second horizontal wall section 130. The beads of sealant are run between the protrusions 146 and 148 and have a thickness slightly larger than the depth of the protrusions 146, 148. The dual channel drainage seal 100 is then positioned over the trench such that the bottom surface 132 of the second horizontal wall section 130 is seated on the slab 14 and the outer surface 104 of the first vertical wall section 102 is seated against the lower sidewall 16. Pressure is applied to the dual channel drainage seal 100 having downward force component and a horizontal force component to provide an uninterrupted and complete seal against the slab 14 and sidewall 16. A person of ordinary skill in the art will appreciate that the sealant can instead be applied directly to the slab 14 and the wall 16. Then the dual channel drainage seal 100 is positioned over the trench and the appropriate pressure forces are manually applied to the dual channel drainage seal to create a permanent seal against the slab 14 and the wall 16. Once the dual channel drainage seal 100 is properly positioned and set, the sealant is then allowed to cure and dry without further movement or disturbance.

Figure 13B:
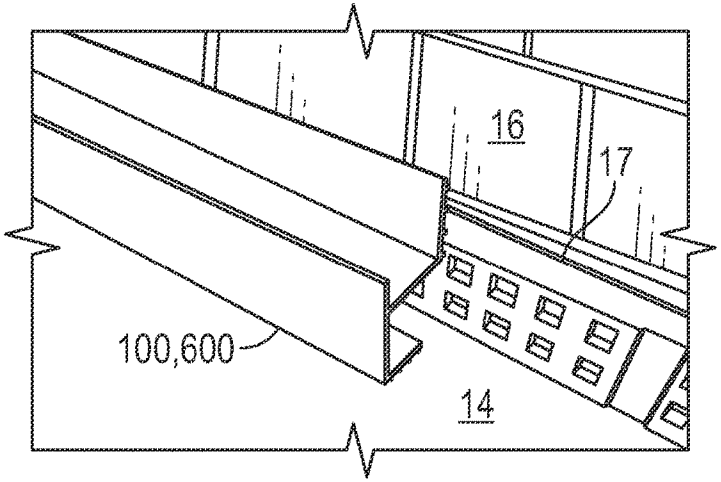
FIG. 13A-13D depict installation positions of the dual channel drainage seal device of FIG. 4 under various basement wall and floor conditions.
Figure 13D:
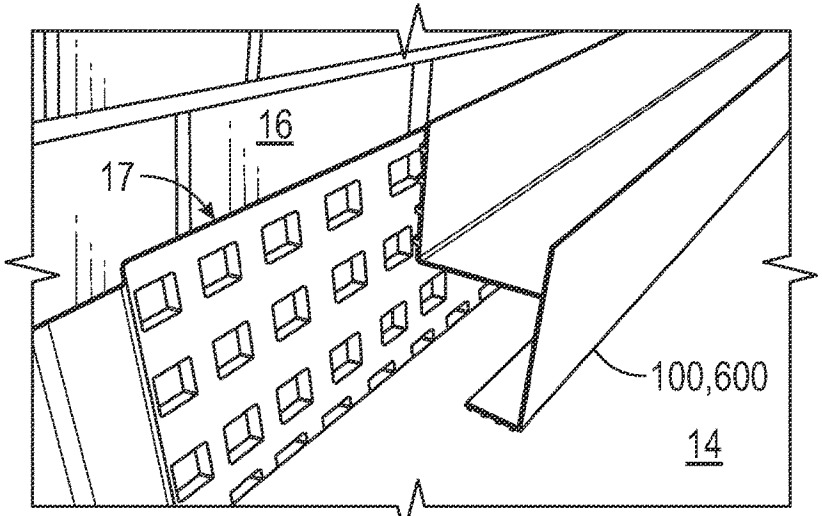
Figure 13A:
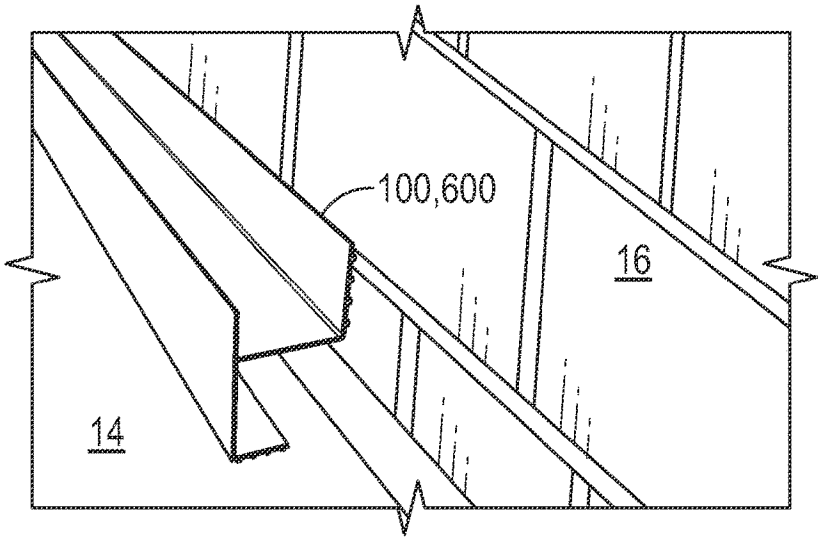
Figure 13C:
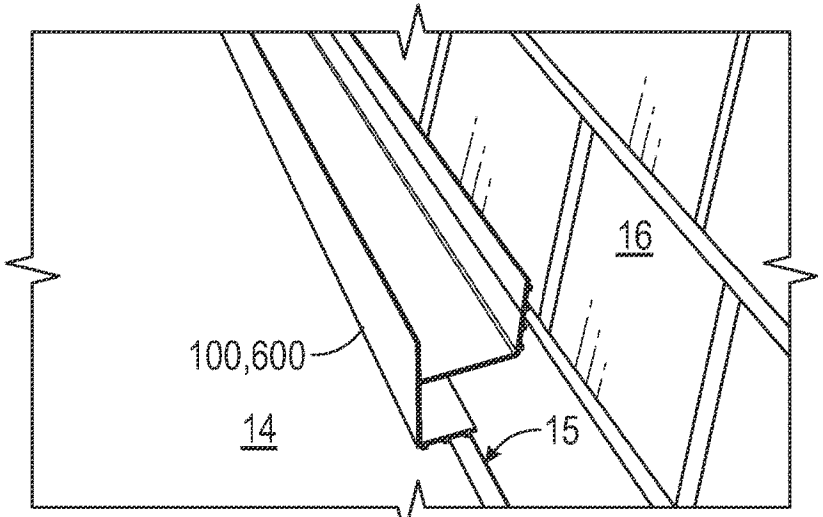
Figure 14B:
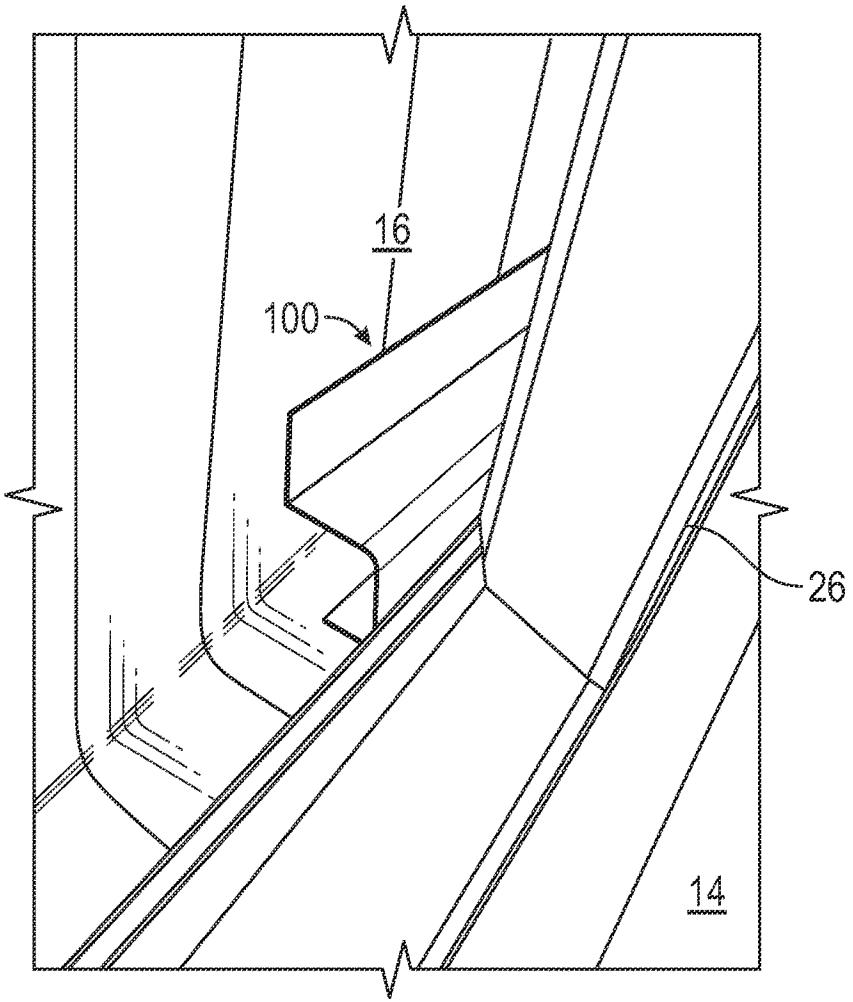
FIGS. 14A-14B depict installation positions of the dual channel drainage seal device of FIG. 4 between a studded wall and the foundation wall of the basement room.
Figure 14A:
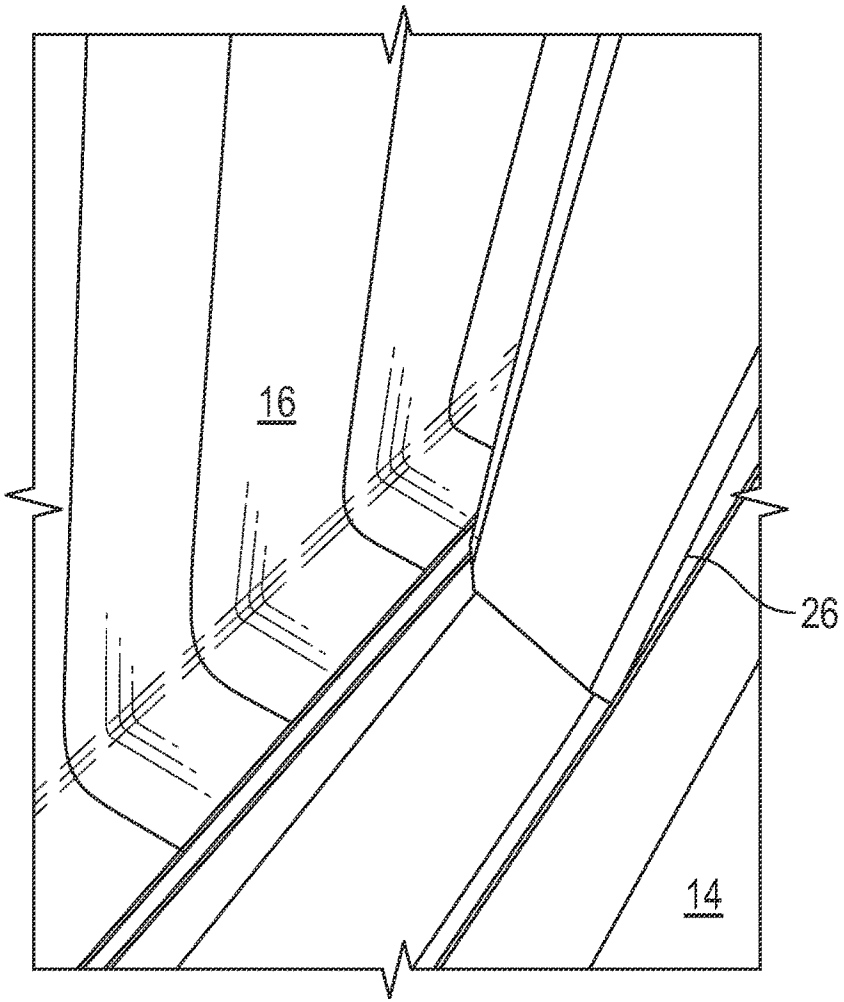

Referring now to FIGS. 13A-13D, the dual channel drainage seal 100, 600 is illustratively shown installed around the interior perimeter of the basement or subterranean area. The dual channel drainage seal 100, 600 can be successfully implemented with most types of basement slab/wall arrangements. For example, the drainage seal 100, 600 can be used in a closed basement without any trench or drainage system, as illustratively shown in 13A; with a French drain as shown in FIGS. 13B and 13D; or with a floating floor having a trench 15, as illustratively shown in FIG. 13C. As well, the dual channel drainage seal 100, 600 can be installed along the perimeter of radian heated basement floors, as illustratively shown in FIG. 14A and/or behind studded walls 30 or finished wall in the basement 10, as illustratively shown in FIGS. 14B and 15.

Figure 15:
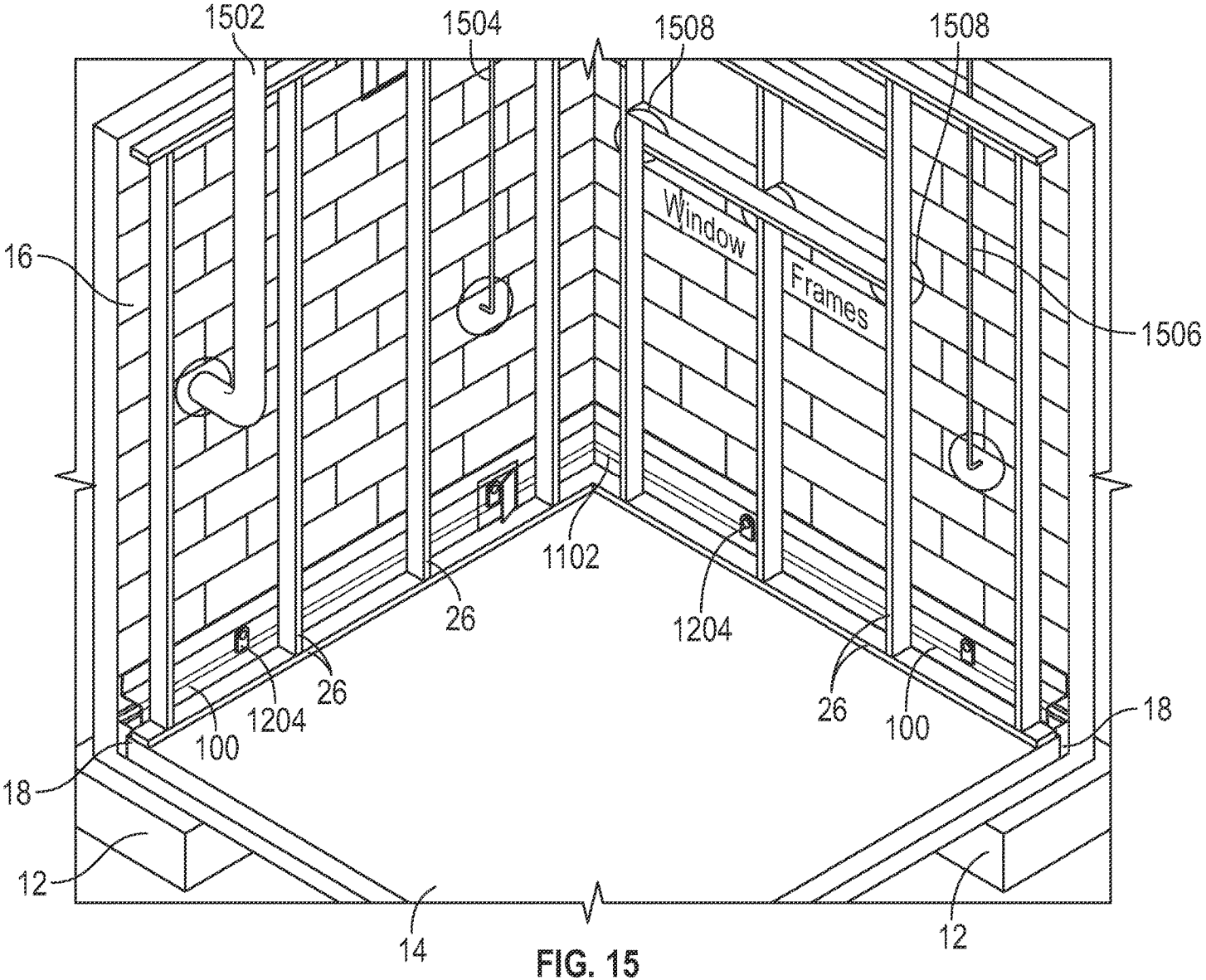
FIG. 15 depicts a partial perspective view of a basement area having a studded interior wall for a finished basement and illustrating the dual channel drainage seal device installed between the basement wall and the studded wall.

Referring to FIG. 15, the water detection system 1200 can include the water/radon detectors 1204, 1206 positioned proximate areas in the basement 10 which are susceptible to leakage through the walls, such as the sewer line 1502, water line 1504, gas line 1506 and window openings/frame areas 1508. Accordingly, the combination of the dual channel drain seal 100 and the water detection system 1200 can prevent water damage to the basement and alert a home owner of a potential water/radon problem as soon as leakage accumulates in the seal device 100.

Figure 12:
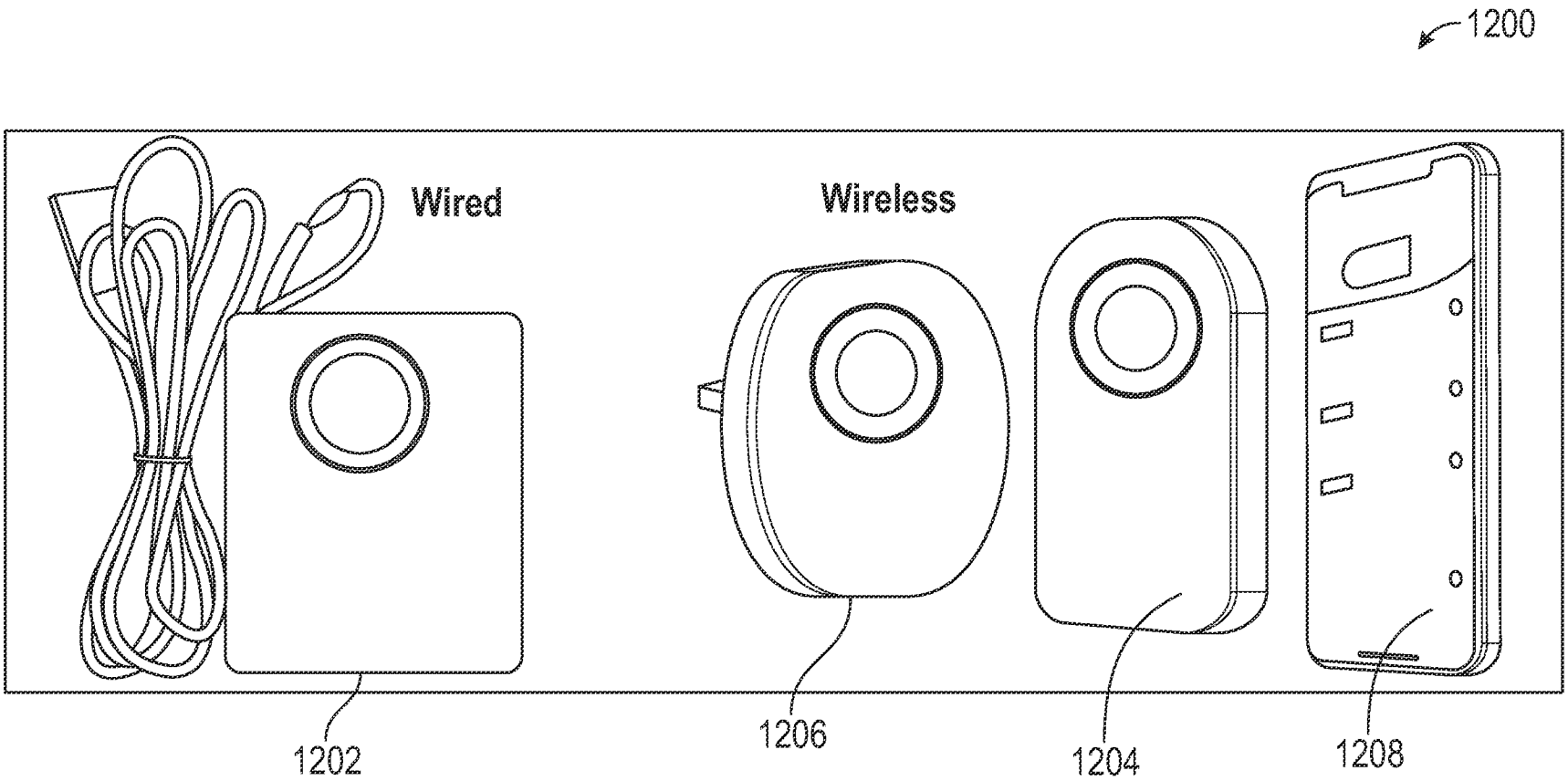
FIG. 12 depicts various electronic sensors and communication devices for sensing liquid accumulating in the dual channel drainage seal device of FIG. 4.

In any of the illustrative basement arrangements, the novel dual channel drainage seal 100, 600 can further include a water and vapor monitoring system 1200 to provide an alarm/alert if a gas/water leak occurs. Referring to FIGS. 7 and 12, the basement area can be provided with a water and vapor monitoring system 1200 to provide an alert if a gas/water leak occurs. The water/vapor monitoring system 1200 can include a wired moisture detector 1202 or a wireless moisture detector 1204, as well as a radon or vapor detector 1206. Referring to FIG. 7, a wired moisture detector 120 and a wireless radon detector 106 are illustratively installed in the basement 10 by plugging in the device into an ordinary 15/20-amp, 120-volt electrical socket in a well-known manner. The water/vapor monitoring system 1200 can be any well-known, commercially available moisture/radon monitoring systems. The electronic monitoring devices 1202, 1204, 1206 can be positioned to monitor either or both of the lower and channels 140, 142 of the dual channel drain seal 100, 600. For example, a conductive wire extending from the water monitoring device 1202 can be positioned to reside in the lower channel 140 and/or the upper channel 142 of the dual channel drain seal between the fire stops, such that if moisture accumulates, the conductive wire will cause the monitoring device 1202 to sound an alarm and/or send an alert to an application program 1208, for example, that is loaded on a homeowner's cell phone in a well-known manner.

The dual channel drain seal 100, 600 helps prevent radon from entering between the joint 18 between the sidewalls 16 and slab 14 of a basement or subterranean area 10. As well, any seepage of water at the joint 18, which may be due to excessive hydrostatic pressure from the water table below the slab 18, is retained within the lower channel 140 and routed to a sump pit 25 for collection and controlled discharge out of the basement 10. Thus, the lower channel 140 of the dual channel drain seal helps control gas and water seepage through the joint 18 between the sidewalls 16 and slab 14 of a basement or subterranean area 10. Installing the dual channel drain seal facilitates drainage of leaks at the joint and sidewall to a sump or other drainage area to help prevent mold and mildew from forming in the basement areas, especially behind a finished wall, which is often difficult to detect. Advantageously, the dual channel drain seal 100, 600 is installed on top of the slab 14 or within the trench 15 formed within the slab, thereby eliminating the need to fully breakup and excavate the slab at the joint area 18. Further, the upper channel 142 collects any water seepage through the sidewall of the basement and also routes such fluid to the sump 25 for collection and discharge out of the basement 10.

While the foregoing is directed to embodiments of the present innovation, other and further embodiments and advantages of the innovation can be envisioned by those of ordinary skill in the art based on this description without departing from the basic scope of the innovation, which is to be determined by the claims that follow.

REFERENCE DESIGNATIONS

8 Liquid seepage
10 Basement
12 Foundation footing
14 Slab
15 Trench
16 Foundation/basement walls
17 French drain
18 Joint
20 Barrier
25 Sump
26 Studded walls
30 Drainage device
32 First vertical section
34 First horizontal section
36 Sloped declining section
38 Lip
40 Second vertical section
42 Second horizontal section
44 Wall
46 Resilient seals
48 Gussets
100 $1^{st}$ embodiment Dual channel drainage seal
102 $1^{st}$ vertical wall section
103 Top edge
104 Outer rear surface
105 Bottom edge
106 Inner surface
110 $1^{st}$ horizontal wall section
112 Top surface
114 Bottom surface
120 $2^{nd}$ vertical wall section
121 Top edge
122 inner surface
123 Bottom edge
124 outer front surface
130 $2^{nd}$ horizontal wall section
132 Bottom surface
134 Top surface
140 Lower channel
142 Upper channel
146 Protrusions
148 Protrusions
600 $2^{nd}$ embodiment Dual channel drainage seal
1102 corner section
1104 right angle channel
1200 water and vapor monitoring system
1202 wired water detector
1204 wireless water detector
1206 vapor detector
1208 application program
1502 sewer line
1504 water line
1506 gas line
1508 window frame.

What is claimed is:

1. A dual channel drainage seal for enclosing a joint between a slab and a foundation sidewall of a subterranean area, the dual channel drainage seal comprising:

a first vertical wall section having an outer surface configured for placement against the foundation sidewall and an opposing inner surface;

a second vertical wall section spaced-apart from the first vertical wall section and having an inner surface;

a first horizontal wall section having a first end affixed to a lower portion of the inner surface of the first vertical wall section and a second end affixed to a mid-portion of the inner surface of the second vertical wall section;

a second horizontal wall section affixed to a lower edge of the second vertical wall section, the second horizontal wall section being configured for placement against the slab, wherein the first and second horizontal wall sections and the first and second vertical wall sections are fabricated from a non-perforated, fluid impermeable material; and wherein the second horizontal wall section, a lower portion of the second vertical wall section and a bottom surface of the first horizontal wall section collectively define a lower channel, and wherein an upper surface of the first horizontal wall section, a portion of the first vertical wall section which extends above the first horizontal wall section, and an inner surface of the second vertical wall section which extend above the first horizontal wall section collectively define an upper channel of the dual channel drainage seal, wherein the upper channel is arranged over and is isolated from the lower channel such that the upper channel and lower channel are impermeable to fluid flow therebetween.

2. The dual channel drainage seal of claim 1, wherein the lower channel is arranged over the joint to channel radon gas admitted through the joint away from the subterranean area.

3. The dual channel drainage seal of claim 1, wherein the lower channel is arranged over the joint to direct flow of liquids accumulating therein to a sump or discharge conduit.

4. The dual channel drainage seal of claim 3, wherein the dual channel drainage seal is fabricated from polyvinylchloride material.

5. The dual channel drainage seal of claim 1, wherein the outer surface of the first vertical wall section includes a plurality of protrusions.

6. The dual channel drainage seal of claim 1, wherein the bottom surface of the second horizontal wall section includes a plurality of protrusions.

7. The dual channel drainage seal of claim 1, wherein the first vertical wall section is perpendicular to the first horizontal wall section.

8. The dual channel drainage seal of claim 1, wherein the second vertical wall section is perpendicular to the second horizontal wall section.

9. The dual channel drainage seal of claim 1, wherein the second vertical wall section is perpendicular to the first horizontal wall section.

10. The dual channel drainage seal of claim 1, wherein the first horizontal wall section is affixed to a lower edge of the first vertical wall section.

11. A subterranean area having the dual channel drainage seal of claim 1 positioned over the joint between the slab and the foundation sidewall of the subterranean area.

12. The subterranean area of claim 11, in which the subterranean area is a basement of an edifice.

13. The subterranean area of claim 11, in which the dual channel drainage seal is positioned between the foundation sidewall and a studded or finished wall in the subterranean area.

14. An elongated dual channel drainage seal for enclosing a joint between a slab and a foundation sidewall of a subterranean area, the elongated dual channel drainage seal comprising:

an impermeable upper drainage channel stacked over a lower drainage channel, the lower drainage channel having at least one sidewall configured to abut against the slab and form an enclosure between the slab and the foundation sidewall; and the impermeable upper drainage channel having at least one sidewall configured to abut against the foundation sidewall, wherein the at least one sidewall forms a U-shaped channel having a top opening configured to collect seepage through the foundation sidewall at height above the U-shaped channel, and wherein the impermeable upper drainage channel is arranged over and is isolated from the lower drainage channel such that the upper drainage channel and lower drainage channel are impermeable to fluid flow therebetween.

15. The elongated dual channel drainage seal of claim 14, wherein the impermeable upper drainage channel routes collected seepage therein to a sump pit.

16. The elongated dual channel drainage seal of claim 14, wherein the lower drainage channel routes seepage from the joint to a sump pit.

17. The elongated dual channel drainage seal of claim 14, which is mounted between the foundation sidewall and a studded or finished wall in the subterranean area.

18. The elongated dual channel drainage seal of claim 14 in which a section of the impermeable upper drainage channel stacked over the lower drainage channel is formed as arranged as a right-angle section to interface with a corner portion of the foundation sidewall of a subterranean area.

19. The elongated dual channel drainage seal of claim 1 in which a section of the impermeable upper drainage channel stacked over the lower drainage channel is formed as arranged as a right-angle section to interface with a corner portion of the foundation sidewall of a subterranean area.

20. The elongated dual channel drainage seal of claim 1 in which at least one sensor is positioned within the upper channel and/or lower channel for sensing liquid accumulating in the dual channel drainage seal device.

* * * * *